US008449337B2

(12) United States Patent
Jehmlich et al.

(10) Patent No.: US 8,449,337 B2
(45) Date of Patent: May 28, 2013

(54) PLUG AND PLUG CONNECTOR FOR ROBOTS

(75) Inventors: Rico Jehmlich, Weil am Rhein (DE); Manfred Müller, Röhrmoos (DE)

(73) Assignee: Multi-Holding AG, Allschwil (CH)

( * ) Notice: Subject to any disclaimer, the term of this patent is extended or adjusted under 35 U.S.C. 154(b) by 0 days.

(21) Appl. No.: 13/475,834

(22) Filed: May 18, 2012

(65) Prior Publication Data

US 2012/0231672 A1 Sep. 13, 2012

Related U.S. Application Data

(62) Division of application No. 12/742,041, filed as application No. PCT/CH2008/000434 on Oct. 16, 2008, now Pat. No. 8,206,185.

(30) Foreign Application Priority Data

Nov. 7, 2007 (CH) ..... 1730/07

(51) Int. Cl.
*H01R 13/502* (2006.01)
*H01R 13/514* (2006.01)

(52) U.S. Cl.
USPC ..... 439/701; 439/928

(58) Field of Classification Search
USPC ..... 439/701, 928, 61
See application file for complete search history.

(56) References Cited

U.S. PATENT DOCUMENTS

| | | | | |
|---|---|---|---|---|
| 5,267,878 | A | 12/1993 | Shinji et al. | |
| 5,449,299 | A * | 9/1995 | Shimirak et al. | 439/417 |
| 5,725,397 | A | 3/1998 | Fukamachi et al. | |
| 5,890,930 | A | 4/1999 | Gerow | |
| 6,008,985 | A | 12/1999 | Lake et al. | |
| 6,688,922 | B2 | 2/2004 | Schreier et al. | |

FOREIGN PATENT DOCUMENTS

| | | | |
|---|---|---|---|
| EP | 0655804 | A2 | 5/1995 |
| EP | 1154521 | A1 | 11/2001 |
| JP | 11176517 | A1 | 7/1999 |

* cited by examiner

*Primary Examiner* — Javaid Nasri
(74) *Attorney, Agent, or Firm* — Browdy and Neimark, PLLC

(57) ABSTRACT

A plug for a tool changing system for electrically connecting a tool to a robot hand, including a plug housing to be fastened on a robot arm or on a tool. The plug housing includes a contact chamber and an accommodating chamber arranged substantially above the contact chamber. A connection module having electrically conductive elements is connected to a first peripheral device. The connection module can be arranged in the contact chamber, and a wear module having electrically conductive elements to be connected to a second peripheral device. The connection module and the wear module are arranged in the accommodating chamber. The electrically conductive elements of the connection module can be connected to the electrically conductive elements of the wear module; and the accommodating chamber is arranged in a frame element which is configured separately from the plug housing. The frame element can be connected to the plug housing.

35 Claims, 9 Drawing Sheets

PLUG AND PLUG CONNECTOR FOR ROBOTS

TECHNICAL FIELD OF THE INVENTION

The present invention relates to a plug or a plug-type connection, in particular for a tool changing system for connecting a tool to a robot hand, in which a plug housing is provided to be fastened on a robot arm or on a tool, wherein the plug housing comprises at least one contact chamber and at least one accommodating chamber, which is arranged substantially above the contact chamber, and wherein a connection module with electrically conductive elements for connection to at least one first peripheral device, in particular a cable, can be arranged in the at least one contact chamber, and a wear module with electrically conductive elements for connection to a second peripheral device, in particular a complementary plug, can be arranged in the at least one accommodating chamber, wherein the electrically conductive elements of the connection module can be connected to the electrically conductive elements of the wear module, and a plug-type connection, in particular for producing an electrical contact between a robot hand and a tool, comprising a socket-side plug (B) and a pin-side plug (S).

PRIOR ART

The prior art has disclosed plug-type connections for connecting a tool to a robot or a hand of a robot arm. Such robots are used, for example, by the automotive industry in manufacturing plants. Typically, such robots comprise a robot arm, whose front end which is remote from the base is referred to as the robot hand. The robot hand serves the purpose of accommodating a tool changing system. Generally, the tool changing system comprises at least two elements, namely a supply side, which is fixedly connected to the robot hand and can therefore also be referred to as the robot side, and a consumer side, which is fixedly connected to the tool on the tool side. The tool changing element comprises mechanical coupling means or modules for mechanically accommodating the tool and an energy-supplying coupling means for supplying the tool with energy.

The energy-supplying coupling means can be, for example, a plug-type connection which is connected via an automatic plugging operation. The tool is supplied with control signals and electrical power from peripheral devices via this plug-type connection. The mechanical and electrical requirements placed on the plug-type connections are extremely stringent and complex.

Since a robot on an assembly line typically performs a plurality of operations one after the other, this can make one or more tool changes necessary. The number of tool changes therefore constitutes a stipulation in respect of the plug-type connection. A large number of plugging cycles which is typically in the region of one million is implemented throughout the life of a tool or a robot.

A further problem is that of crosstalk between individual electrical connections. In particular, the control signals are extremely sensitive to such crosstalk. In the case of the plug-type connections from the prior art, the plugs for power transmission are therefore always arranged physically separated by a long way from the plugs for signal transmission. As a result, the enveloping circle of the plug around the tool changing element is extremely large. This problem is additionally intensified if, for example, a plurality of different tools are intended to be coupled. The freedom of movement of the robot is therefore restricted.

DESCRIPTION OF THE INVENTION

Against the background of this prior art, the invention is based on the object of specifying a plug connection which overcomes the disadvantages of the prior art. In particular, the problem of making the enveloping circle around the coupling point smaller is addressed. In addition, individual connecting channels of the entire plug-type connection should be capable of being replaced in a manner which is as simple as possible. In addition, the plug-type connection is intended to be configured in such a way that it is robust with respect to mechanical influences and loads.

This object is achieved by a plug in which a plug housing is provided to be fastened on a robot arm or on a tool, wherein the plug housing comprises at least one contact chamber and at least one accommodating chamber, which is arranged substantially above the contact chamber, and wherein a connection module with electrically conductive elements for connection to at least one first peripheral device, in particular a cable, can be arranged in the at least one contact chamber, and a wear module with electrically conductive elements for connection to a second peripheral device, in particular a complementary plug, can be arranged in the at least one accommodating chamber, wherein the electrically conductive elements of the connection module can be connected to the electrically conductive elements of the wear module. Advantageous configurations of the invention are specified in the dependent claims.

Accordingly, a socket-side plug or pin-side plug, in particular for a tool changing system for electrically connecting a tool to a robot hand, comprises a plug housing to be fastened on a robot arm or on a tool. The plug housing comprises at least one contact chamber and at least one accommodating chamber, which is arranged substantially above the contact chamber. A connection module with electrically conductive elements for connection to at least one first peripheral device, in particular a cable, can be arranged in the at least one contact chamber, and a wear module with electrically conductive elements for connection to a second peripheral device, in particular a complementary plug can be arranged in the at least one accommodating chamber. The electrically conductive elements of the connection module can be connected to the electrically conductive elements of the wear module.

The individual wear modules and connection modules can be replaced separately. As a result, defects can be eliminated quickly and efficiently.

Preferably, in the case of a socket-side plug, the electrically conductive elements in the wear module of the plug are electrically conductive socket elements.

Preferably, in the case of a pin-side plug, the electrically conductive elements in the wear module of the plug are electrically conductive pin elements.

The two wear modules can be connected to one another via the socket elements and the pin elements. The socket element is connected to the connection element associated therewith, and the pin element is connected to the connection element associated therewith. This results in a sandwich-like construction, which comprises the connection element and the wear element in each case per plug, i.e. per socket side and per plug side.

The accommodating chambers are preferably arranged in a frame element, which is configured separately from the plug housing. The frame element can be connected to the plug housing.

Owing to the arrangement of the wear elements in the frame element, all of the wear elements can be separated from the plug housing in one working step. In turn, this is very helpful in the case of repair work, since this repair work can be performed quickly.

The electrically conductive elements in the connection module preferably have a first side for connection to a peripheral device and a second side for connection to the electrically conductive elements of the wear module. The first peripheral device is a cable, for example, which is connected to a signal transmitter, a power section etc.

The connection modules and the wear modules are preferably made from an elastic and/or electrically insulating material. As a result, the connection modules and the wear modules can be inserted into the corresponding chambers without the use of a tool. In addition, positional errors or angle errors of the plugs can be compensated for when a contact is produced. In addition, a plurality of electrical connections with different potentials can be guided through the corresponding module.

Preferably, the connection modules and the wear modules have through-openings, which serve the purpose of accommodating the electrically conductive elements.

The electrically conductive elements in the connection module can preferably be connected to the electrically conductive elements in the wear module via a plug-type connection. As a result, the wear modules can be separated from the connection modules in a particularly simple manner.

Preferably, the connection modules have a substantially identical design for the socket side and the pin side of the plug. In other words, this means that only a single connection module needs to be provided, which can then be used in the plug on the socket side and in the plug on the pin side.

Preferably, the hole pattern of the openings in the connection module is identical to the hole pattern of the openings in the corresponding wear module.

Preferably, the contact chamber comprises guide elements for guiding the connection module and/or latching elements for latching the connection module. As a result, the connection modules can be inserted and latched into the contact chamber in a particularly simple manner. Preferably, the latching elements are self-latching.

Preferably, the accommodating chamber comprises latching elements for latching the wear module.

The insertion direction of the connection modules into the plug housing is preferably at an angle, in particular at right angles, to the insertion direction of the wear modules into the plug housing or the frame element.

Preferably, lateral play is provided between the connection module and the contact chamber and/or the wear module and the accommodating chamber, wherein the lateral play is preferably between 0.25 mm and 0.5 mm per side. As a result, angle errors or positional errors can be compensated for when the plug is connected to another plug.

Preferably, the first peripheral device is a cable, which can be guided out of the plug via an opening and/or a channel.

In addition, the intention is to provide a plug connection which enables the simultaneous transmission of control signals and of electrical power for driving electrical actuators.

Preferably, the surfaces of the contact chambers are provided with an electrically conductive coating, wherein the coatings of the individual contact chambers are DC-isolated from one another and/or DC-connected to one another. Particularly preferably, the electrically conductive coating is a metallic coating. The electrically conductive coating serves the purpose of shielding the contact chamber, wherein crosstalk between the modules arranged in the individual chambers can be prevented.

Preferably, the shield of a cable on the socket side can be connected to an electrically conductive element, and the shield of a cable on the pin side can be connected to an electrically conductive element, with the result that the shield can be guided via the electrically conductive elements from the pin side to the socket side.

A method for assembling a plug as described above, wherein in advance the connection modules are equipped with electrically conductive elements, which are connected to a first peripheral device, in particular a cable, and the wear modules are equipped with electrically conductive elements, and wherein, then, the connection modules are arranged in the contact chambers and the wear modules are arranged in the accommodating chambers.

In addition, the method preferably comprises the arrangement of the wear modules in the accommodating chambers in the frame element and then the connection of the frame elements to the corresponding plug housing.

With the method according to the invention, the plugs according to the invention can be connected to one another in a particularly efficient manner.

In addition, a plug-type connection according to the invention is specified, in particular for producing an electrical contact between a robot hand and a tool, which plug-type connection comprises a socket-side plug and a pin-side plug.

Further advantageous embodiments are characterized in the dependent claims.

BRIEF DESCRIPTION OF THE DRAWING

The invention will be described by way of example in more detail below with reference to the drawing, in which.

DESCRIPTION OF THE EXEMPLARY EMBODIMENTS

Possible exemplary embodiments will be described with reference to the drawings. The drawings and the description disclose preferred exemplary embodiments and should not be interpreted as restricting the invention, which is defined by the claims.

Figure 1A:
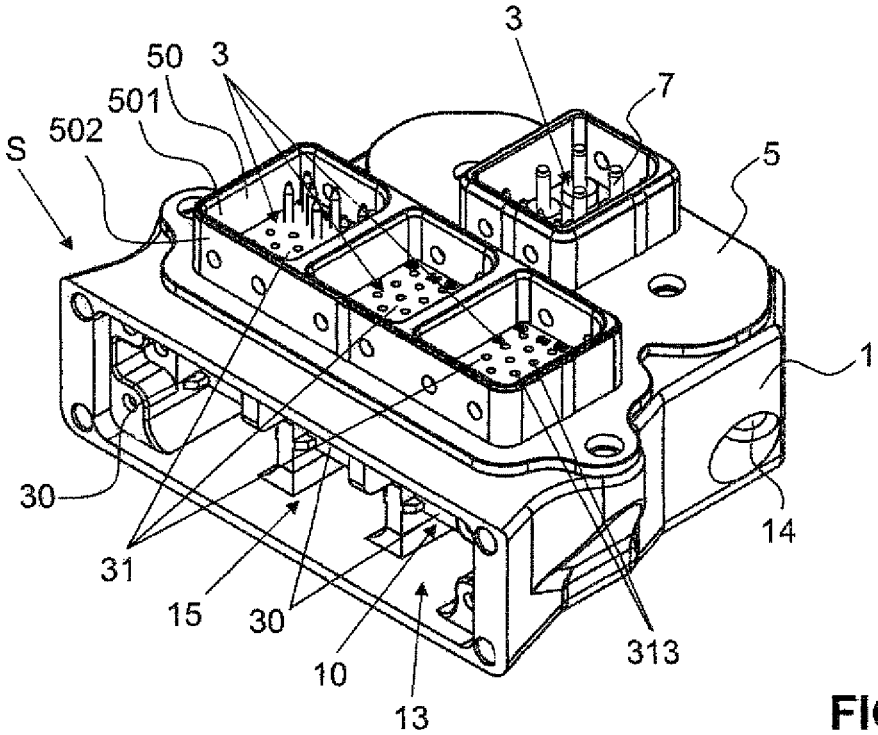
FIG. 1*a* shows a perspective view of the pin side of a plug according to the invention.
Figure 1B:
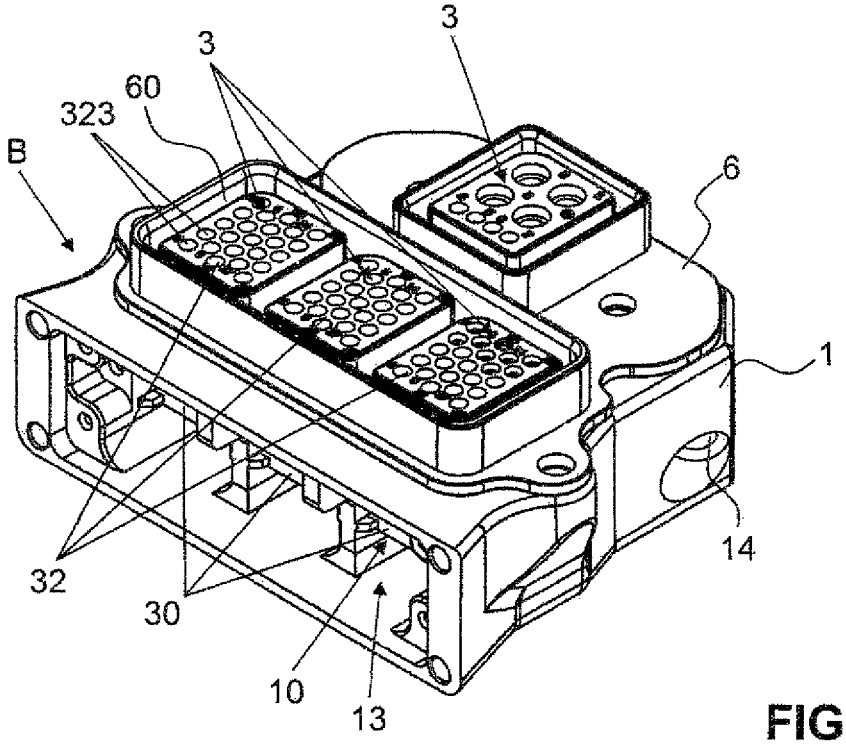
FIG. 1*b* shows a perspective view of the socket side of a plug according to the invention.

FIG. 1*a* shows a perspective view of the pin side S of a plug according to the invention and FIG. 1*b* shows a perspective view of the socket side B of a plug according to the invention. The pin side S is understood to mean the side of a plug on which electrically conductive contact pieces are in the form of plugs, which protrude beyond a plane. Colloquially, the pin side is also referred to as the "male" side. The socket side B is understood to mean the side of a plug on which the electrically conductive contact elements are in the form of a socket and are substantially completely surrounded by insulating material. Colloquially, the socket side is also referred to as the "female" side. The plug of the pin side S can enter into an electrically conductive interconnection with the plug on the socket side B via a mechanical connection. In other words, the plug according to the invention on the pin side S and the plug according to the invention on the socket side B provide an electrically conductive plug-type connection.

Both the plug on the pin side S and the plug on the socket side B comprise in each case an integral plug housing 1 and a frame element 5, 6. The plug housing 1 on the socket side B is designed to be substantially identical to the plug housing 1 on the pin side S. The plug housing 1 comprises at least one contact chamber 10 and the frame element 5, 6 comprises at least one accommodating chamber 50, 60. The frame element 5, 6 can be connected to the plug housing 1, wherein the at least one accommodating chamber 50, 60 is positioned substantially above the at least one contact chamber 10, 20. This arrangement one above the other can also be referred to in other words as an aligned arrangement. The plug housing 1 and the frame element 5, 6 are preferably made from a polymer. An injection molding process is preferably used for production. Other methods are also conceivable.

In addition, the plug according to the invention comprises a plug module 3, which serves the purpose of producing an electrically conductive contact between the pin side S and the socket side B. The plug modules are intended for different applications. The plug module 3 comprises substantially a connection module 30 and a wear module 31, 32. The connection module 30 is accommodated by the plug housing 1 and the wear module 31, 32 is accommodated by the frame element 5, 6. The connection module 30 on the pin side S is designed to be substantially identical to the connection module 30 on the socket side B. The wear module 31 on the pin side S is preferably designed to be non-identical to the wear module 32 on the socket side B. The connection module 30 and the wear modules 31, 32 are made from an electrically nonconductive material, preferably from a rubber-like polymer, such as an elastomer. Preferably, the connection module 30 is made from a softer polymer than the wear modules 31, 32.

The connection module 30 and the wear modules 31, 32 comprise openings 303, 313, 323 for accommodating electrically conductive elements 7. The openings 303, 313, 323 are arranged so as to be spaced apart from one another, for which reason the electrically conductive elements 7 which are located in adjacent openings 303, 313, 323 are electrically insulated from one another. In addition, the openings 303, 313, 323 pass through the corresponding module 30, 31, 32 completely. Accordingly, one electrical signal (for example control signal) or one phase (electrical power) can be transmitted per opening 303, 313, 323. This means that a large number of electrical signals or phases can be transmitted per plug module 3. The connection modules and the wear modules 31, 32 have a substantially identical outer shape in the direction of the openings 303, 313, 323. In particular, the openings 303 of the connection modules 30 run collinearly with respect to the openings 313, 323 of the wear modules.

The plug module 3 can be configured as a data module for transmitting control data or as a servo module for transmitting electrical power, for example. The data module can have 23 individual pins, for example, and can transmit signals in the region of 250V/16A. Higher or lower voltages/currents are also conceivable. The servo module can have, for example, 3 to 4 pins for transmitting a maximum of 690 V/32 A plus 2 pins for passing through the shield. Mention is also made here by way of a third example of a ProfiNet module with shielding, for example Cat5e, which is used for transmitting bus signals.

In order to produce the electrically conductive contact, both the connection module 30 and the wear module 31, 32 each comprise an electrically conductive element 7 in each case per signal/phase. The electrically conductive elements 7 of the two modules can be connected to one another mechanically via a plug-type connection, with the result that an electrically conductive contact can be produced between the electrically conductive elements 7 arranged in the connection module 30 and the electrically conductive elements 7 arranged in the wear module 31, 32. The electrically conductive elements 7 arranged in the connection module 30 can be connected to at least one first peripheral device, for example by means of a soldered or crimp connection to a cable or cable harness. A first peripheral device is understood to mean, for example, a power regulator, a signal transmitter, a computer, a tool or a similar device which is arranged on the robot side or on the tool side. The electrically conductive elements 7 which are arranged in the wear module 31, 32 are used for connection to a second peripheral device. The second peripheral device is in this case understood to mean the complementary plug. In this case when two plugs are connected to one another, this means that the wear module 31 on the plug side S is positioned opposite the wear module 32 on the socket side B and said modules lie two-dimensionally opposite one another in the state in which contact has been made.

In the two exemplary embodiments shown in FIGS. 1*a* and *b*, the wear elements 31, 32 differ in that the wear elements 31 on the pin side S have a lower height than the wear elements 32 on the socket side B.

Figure 2:
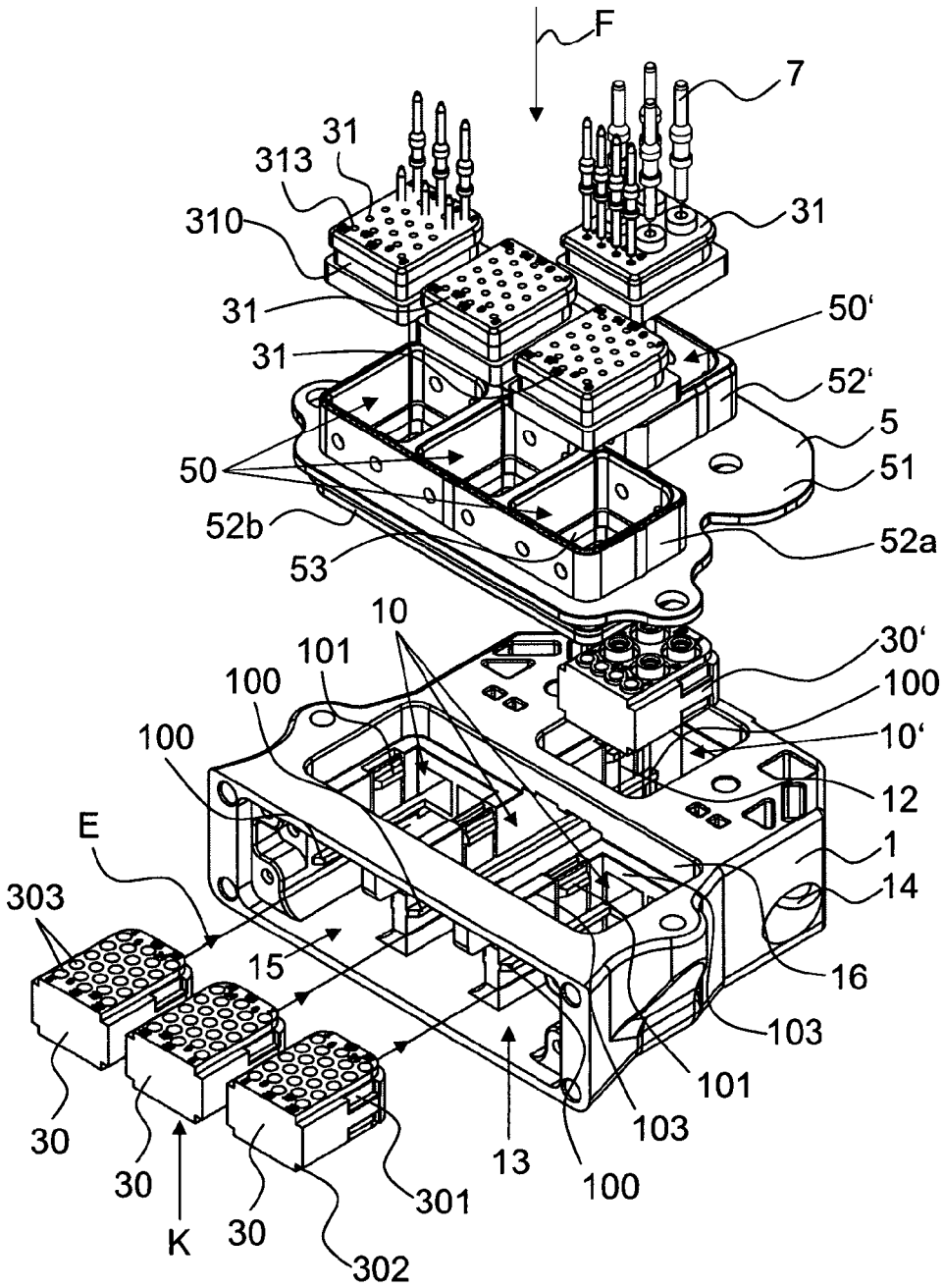
FIG. 2 shows a perspective, exploded illustration of the pin side shown in FIG. 1*a;*

FIG. 2 shows a perspective, exploded illustration of the pin side S, in which the electrically conductive elements are in the form of pins, as shown in FIG. 1*a*. All of the features described with the aid of this drawing can also analogously be applied to the socket side B, wherein the electrically conductive elements on the socket side B are in the form of a socket. The plug housing 1 shown in this exemplary embodiment comprises three contact chambers 10, which are arranged next to one another in a row. In addition, the plug housing comprises a further contact chamber 10', which is arranged behind this row. The contact chambers 10, 10' serve the purpose of accommodating the connection modules 30, 30' of the plug module 3. A channel 15 which is arranged below the contact chambers 10, 10' serves the purpose of passing out a cable which is connected to the connection module 30, 30'. Owing to the arrangement of the contact chamber, the enveloping circle of the plug can be reduced in size. In addition, the contact chambers can be equipped flexibly with different plug modules for different applications.

The three connection modules 30 arranged in a row can be inserted into the corresponding contact chamber 10 in the plug housing 1 along the arrow direction E. The contact chambers 10 are delimited by side walls 103. The side walls 103, which delimit the contact chamber 10 on the left-hand side and the right-hand side when viewed from the insertion direction E, are equipped with guide elements 100, for example ribs. The connection modules 30 are guided via these guide elements 100 in the contact chamber 10. For this purpose, the connection module 30 comprises guide cutouts 302, such as a groove or a recess, for example, which are provided in complementary fashion to the guide elements 100 in the contact chamber 10, with the result that the guide elements 100 of the contact chamber 10 can engage in or on the guide cutouts 302.

In addition, the contact chambers 10 comprise latching elements 101, which are used for latching the connection module 30 in the contact chamber 10. For this purpose, the connection modules 30 have cutouts 301, into which the latching element 101 can engage in self-latching fashion with a latching projection as soon as the connection module 30 is located in the end position. Owing to the configuration of the latching elements 101, said latching elements can be actuated by means of a tool (screwdriver) or manually, with the result that the connection module 30 is released again and can be removed from the contact chamber 10. For this purpose, first the frame element 5, 6 needs to be separated from the plug housing 1, with the result that access to the latching elements through the opening 16 is provided. Thus, the individual elements, in particular the connection elements connected to cables, can be replaced together with the cable in a simple manner.

The arrow K symbolizes the connection of a cable, which connects the electrically conductive elements of the connection module 30 to a first peripheral device. This means that the cable can be prefabricated with the connection module 30 and can then be inserted into the contact chamber 10 in a simple manner through the opening 13 and with the aid of the guide elements 100. In this case, the cable is positioned in the channel 15 and is guided via the opening 13 out of the plug housing. This prefabrication is an advantage because the connection module 30 with the cable can be replaced quickly, for example in the case of a cable breakage or in the case of a defect in a cable. As a result, the downtime of a manufacturing plant can be minimized in the case of a cable defect, and valuable time is not wasted on the connection of a new cable to the connection module 30. The plug can be repaired in an efficient manner since the defective parts (for example connection module or wear module) are replaced easily and it is not necessary for any complex soldering work to be carried out on the plug. The cable K is connected to the electrically conductive elements which are arranged in the connection module 30 via an electrically conductive connection, which is known to a person skilled in the art. In particular, a soldered or crimped connection can be used, for example.

The prefabrication is a significant advantage since it can take place independently of the plug. The connection module can be connected to the cable, for example in a laboratory or a factory. Thus, the connection module 30 now only needs to be inserted into the plug in the production line. The connection of the cable for example by means of a soldering process in the production line is no longer required.

The opening 13 in the plug housing can be closed, for example, by a cover, wherein the cables can be guided via openings in the cover out of the plug housing 1.

The connection module 30' is inserted into the contact chamber 10 at right angles with respect to the insertion direction E, i.e. from above. The connection module 30' can likewise already have been prefabricated with a cable. The cable which is connected to the connection module 30' can be guided via the opening 14 out of the plug housing 1. For this purpose, the cable as yet does not have a plug or the like at the end which is not connected to the connection module 30'. Alternatively, the connection module 30' can also be inserted through the contact chamber 10, which is arranged in front of the contact chamber 10', along the insertion direction E. In this case, the cable is guided via the channel 15 out of the plug housing 1. The contact chamber 10' likewise comprises guide elements 100, wherein in this case the side walls 103 of the contact chamber 10' can likewise be referred to as guide elements, and latching elements 101. As can be seen from FIG. 2, all of the connection elements 30 and 30' have a substantially identical configuration. Thus, the module location can be altered swiftly and quickly. For example, it is conceivable to replace the connection module 30' which is not positioned in said row with a connection module 30 which is positioned in said row, or vice versa.

FIG. 2 shows the frame element 5 on the pin side S. The frame element 5 on the pin side S can also be replaced by the frame element 6 on the socket side B, however, since the plug housing 1 with the connection modules 30 is configured in analogous fashion substantially for the pin side S and for the socket side B. The frame element 5 comprises a carrier element and a plurality of accommodating chambers 50, through which the carrier element 51 passes. The carrier element 51 is used substantially for fastening the frame element 5 on the plug housing 1. The accommodating chambers 50 are used for accommodating the wear modules 31, which are inserted into the contact chamber 50 along the insertion direction F. In the present exemplary embodiment, three accommodating chambers 50 are arranged next to one another in a row, in a similar fashion to the plug housing 1, and an individual accommodating chamber 50' is arranged offset towards the rear with respect to this row. The accommodating chambers 50 are delimited substantially by a side wall 52*a, b*. In this case, the side wall 52*a, b* comprises an upper side wall region 52*a*, which extends from the carrier element 51 upwards (away from the plug housing 1 if connected to the plug housing 1), and a lower side wall region 52*b*, which extends from the carrier element 51 downwards (in the direction of the plug housing 1). The lower side wall region 52*b* is in engagement with the opening 16 in the plug housing 1 in the fitted state.

The accommodating chambers 50 furthermore comprise latching elements 53, which are preferably configured as peripheral ribs in the accommodating chamber 50. The wear modules 31 preferably comprise peripheral cutouts 310, which can also be referred to as grooves. As can be seen from FIG. 2, the wear modules 31 are inserted into the accommodating chambers 50 from above and then latched in self-latching fashion with the aid of the latching elements 53 and peripheral cutouts 310. Owing to the elasticity of the wear modules 31, said wear modules can be inserted and latched into the accommodating chamber 50 with a low amount of force expenditure. Preferably, the wear modules are provided with the electrically conductive elements 7 prior to being inserted into the accommodating chamber 50.

In the assembled state, subregions, in this case the lower side wall region 52*b*, of the accommodating chambers 50 protrude into a complementary opening or step 16 in the plug housing 1. As a result, the frame element 5 is centered relative to the plug housing 1.

The frame element 6 for accommodating the wear modules 32 on the socket side B is designed to be substantially identical, wherein the reference symbols begin with the number 6.

Figure 3:
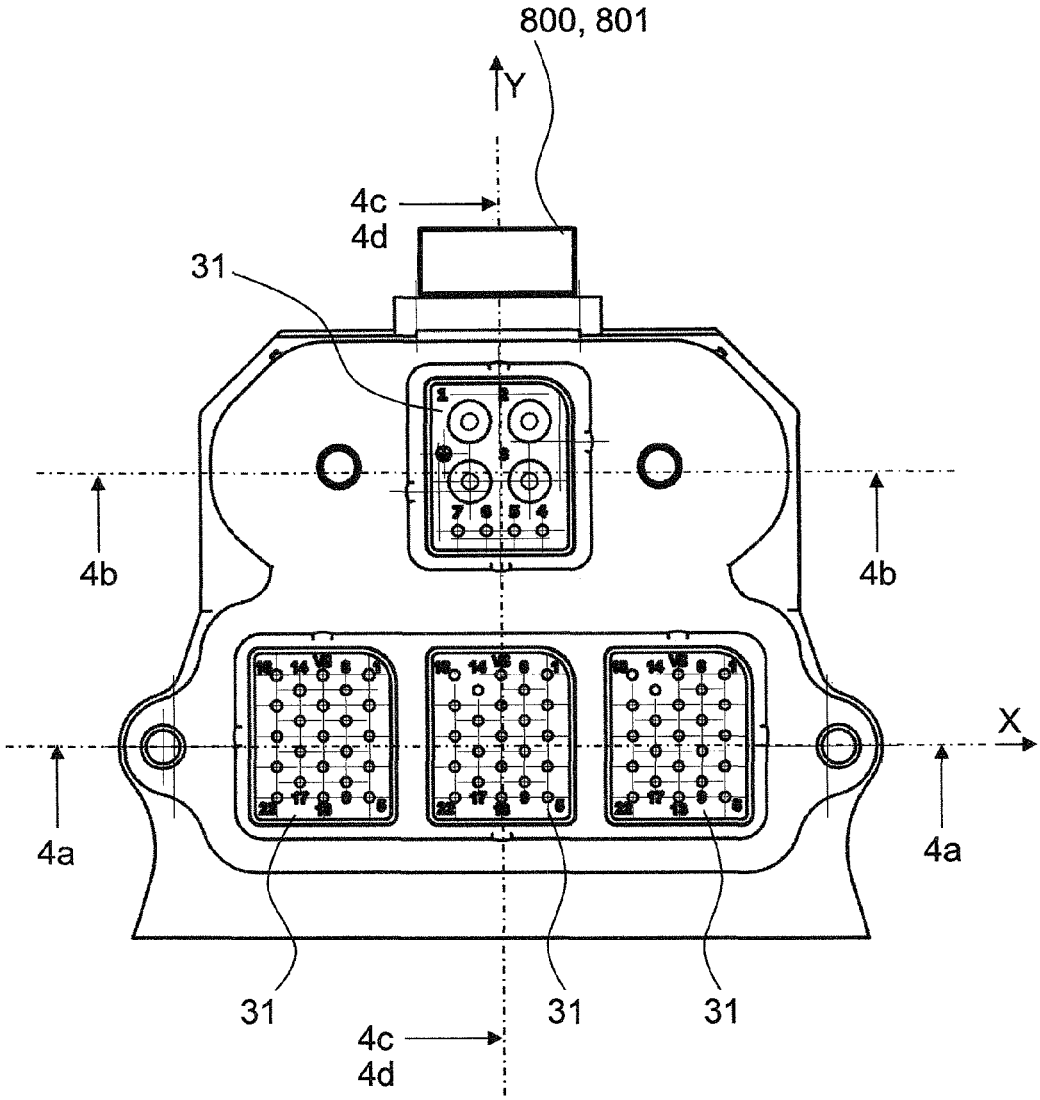
FIG. 3 shows a plan view of a pin side or socket side of a plug in accordance with the present invention.

FIG. 3 shows the plug according to the invention from above and serves to illustrate the position of the sections of the sectional illustrations shown in FIGS. 4*a*, 4*b*, 4*c* and 4*d*.

Figure 4A:
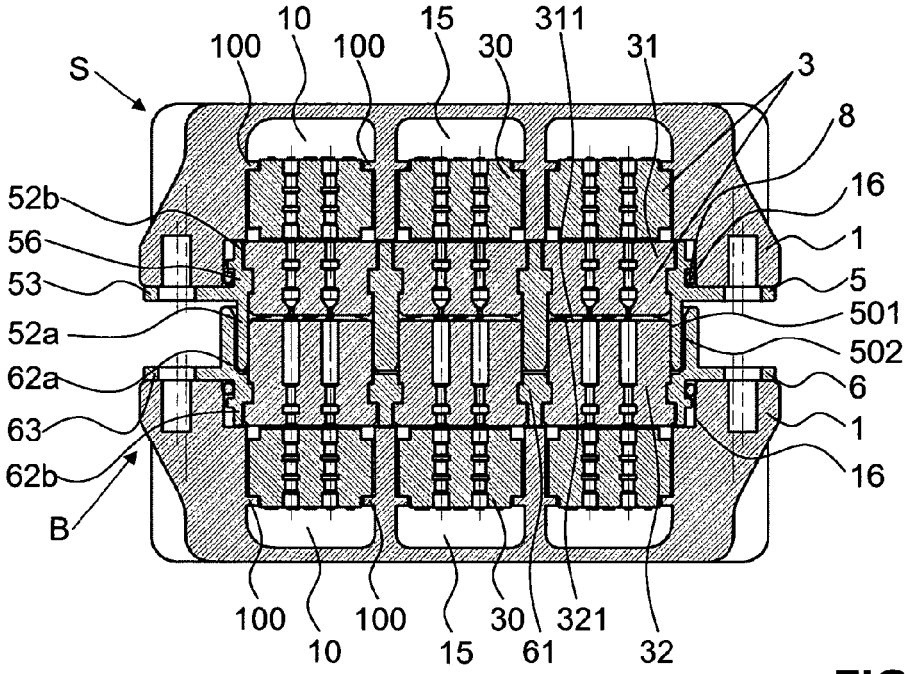
FIG. 4*a* shows a sectional illustration along the section line 4*a*-4*a* in FIG. 3, wherein the pin side is in engagement with the socket side.

FIG. 4*a* shows a sectional illustration of the plug along the section line 4*a*-4*a* in FIG. 3. In this case, the plug on the pin side S is connected to the plug on the socket side B.

The sectional illustration illustrates the arrangement of the plug modules 3 with the connection modules 30 and the wear modules 31, 32. The electrically conductive elements are not shown in this illustration, with reference being made to FIG. 4*b* in this regard. It can be seen from FIG. 4*a* that the connection modules 30 are guided in the contact chamber 10 through the guides 11. In addition, a channel 15 is illustrated, through which the cable can leave the plug body 1 in order to be connected to a peripheral device. The connection modules 30 are therefore accommodated by the contact chamber 10 of the plug housing 1.

The connection modules 30 and also the wear modules 31 are designed to be substantially right-parallelepipedal in the present exemplary embodiment. In this case, openings 303, 313, 323 extend through this right-parallelepipedal body, wherein the openings 303, 313, 323 are used to accommodate the electrically conductive elements 7 (later referred to as pin elements 70, socket elements 71 and connection elements 72). In addition, the openings 303, 313, 323 have cutouts (flutes, grooves) and the pin elements 70, the socket elements 71 and the connection elements 72 have elevations (flutes, grooves) which are complementary to the cutouts and are in engagement with the cutouts. Alternatively, the cutouts can also be arranged in the pin elements 70, the socket elements 71 and the connection elements 72 and the elevations can be arranged in the openings 303, 313, 323.

The sectional illustration likewise shows that the frame element 5 comprises the wear modules 31 for the pin side S. In the general form it can be said that the frame elements 5, 6 accommodate the wear modules 31, 32. In addition, reference is made here to the fact that the surface 311 of the wear modules 31 is located completely in the frame element 5.

The wear modules 32 for the socket side B are arranged in the frame element 6.

This sectional illustration clearly shows that the plug housing 1 with the contact chambers 10 and the connection modules 30 on the socket side B and the plug side S are configured substantially identically. The plug side S and the socket side B accordingly differ substantially in the configuration of the wear modules 31 for the pin side S and the wear modules 32 for the socket side 32, and the two frame elements 5 and 6.

In the present exemplary embodiment shown in FIG. 4*a*, parts of the frame elements 5, 6, namely the side walls 52*b*, 62*b*, which extend from the carrier element 51, 61 in the direction of the plug housing 1, protrude into the plug housing 1. It is likewise shown that the parts of the side edges 52*a*, 62*a*, which extend away from the plug housing 1, are configured in such a way that the side wall 52*a* of the frame element 5 protrudes into the side wall 62*a* of the frame element 6. The two plugs on the pin side and the socket side are guided mechanically relative to one another over these side walls 52*a*, 62*a*, which protrude one inside the other.

Optionally, the frame element 5, 6 can comprise a peripheral groove 56 in the region of the lower side wall 52, which groove 56 can accommodate a seal 8 (for example an O ring). The seal 8 seals off the frame element 5, 6 in this region with respect to the plug housing 1 and at the same time ensures good centering.

Figure 4B:
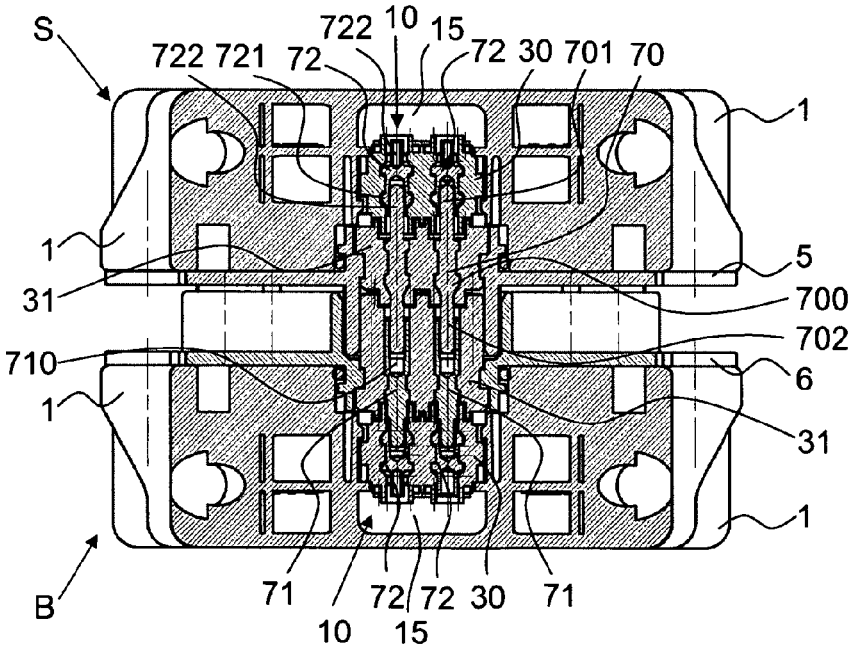
FIG. 4*b* shows a sectional illustration along the section line 4*b*-4*b* in FIG. 3, wherein the pin side is in engagement with the socket side.

FIG. 4*b* substantially serves the purpose of explaining the electrically conductive contact between the pin side S and the socket side B. The electrically conductive element arranged in the wear element 31 on the pin side S is referred to as the electrically conductive pin element 70 here. The electrically conductive element arranged in the wear module 31 is referred to as the electrically conductive socket element 71 here. The electrically conductive elements arranged in the two connection modules 30 are referred to as the electrically conductive connection elements 72.

The connection element 72 has a substantially cylindrical configuration and has latching-in elements 720 on the cylindrical surface, with which latching-in elements 720 the connection element 72 can latch into complementary elements in the corresponding opening in the connection module 30. On the side facing the wear module 31, 32, the connection element 72 comprises a cylindrical opening 721, also referred to as a blind hole, for accommodating a pin or a journal of the pin element 70 or the socket element 71, which is arranged opposite the connection element 73 in the wear module 31, 32. In other words, this means that cylindrical parts of the pin element 70 or the socket element 71 protrude into the blind hole 721. On the side facing the channel 15, the connection element 72 comprises a connection point 722, to which the braided wires of a cable can be connected, as described above.

In alternative embodiments it is also conceivable for the connection element 72 not to be designed to have a cylindrical opening 721, but to have a cylindrical journal. In this case, the pin elements 70 or the socket elements 71 would then be configured to have a blind hole in the corresponding section. This means that the structure of the connection between the connection element 72 and the pin element 70 or the connection element 72 and the socket element 71 can also be exchanged.

The pin element 70 is likewise configured so as to be substantially cylindrical and also has latching elements 700, with which the pin element 70 can latch into complementary elements in the opening of the wear module 31. The pin element 70 has a length which is greater than the height of the wear element 31, i.e. in the latched-in state, the pin element 70 protrudes beyond the wear module 31 on both sides. On the side facing the connection module 30, the pin element 70 is configured so as to have a cylindrical contact section 701. The contact section 701 protrudes into the cylindrical opening 721 of the connection element 72. As a result, an electrical contact between the connection element 72 and the pin element 70 is provided. On the side facing the socket side B, the pin element 70 likewise has a cylindrical contact section 702. The contact section 702 is used for the electrically conductive connection to the socket element 71.

The socket element 71 is designed to be substantially identical to the pin element 70 in the region which is in engagement with the connection element 72. In the region which faces the wear element 31 on the pin side S, the socket element 71 comprises a cylindrical opening 710 (for example a blind hole), which is used for accommodating the contact section 702 of the pin element 70. Likewise, the socket element 71 is configured in such a way that it does not protrude out of the wear module 31 towards the pin side S.

When the frame element 5, 6 is assembled with the plug housing, the connection elements 72 are electrically conductively connected to the corresponding socket elements 71 and pin elements 70, respectively. As soon as the two plugs on the pin side S and on the socket side B are connected to one another, the socket elements 71 on the socket side B and the pin elements 70 on the pin side S are electrically conductively connected to one another.

The connection direction of the plug on the socket side B to the plug on the pin side S is along the direction F, which is preferably at an angle, in particular at right angles, with respect to the insertion direction E of the connection modules 30. In other words, it can also be said that the connection direction is substantially parallel to the insertion direction of the frame element 5, 6 into the plug housing 1. In the connected state, the surface 311 of the wear element 31 is arranged opposite the surface 321 of the wear element 32. The pin elements 70 on the pin side S in this case protrude into the wear elements 31 on the socket side B.

The configuration of the pin elements 70, the socket elements 71 and the connection elements 72 enables particularly flexible and simple handling when replacing one of the elements. Owing to the fact that the wear modules 31 with the frame elements 5, 6 can be separated from the plug housing 1, this can also be referred to as a sandwich-like construction.

This illustration 4*b* also shows the fitting of the plug according to the invention. By way of preparation, the connection modules 30 are equipped with the connection elements 72, which are then connected to a peripheral device. Likewise by way of preparation, the corresponding wear modules 31, 32 are equipped with the pin elements 70 and the socket elements 71, respectively. In a first step, the connection modules 30 are inserted into the corresponding contact chamber 10 along the insertion direction E. In a second step, the wear modules 31, 32 are inserted and latched into their corresponding accommodating chamber 50, 60 in the frame element 5, 6. As the final step, the frame elements 5, 6 are connected to the plug housing 1 along the connection direction F, wherein at the same time an electrically conductive contact between the connection elements 72 and the pin elements 70 or between the connection elements 72 and the socket elements 71 is produced. The frame elements 5, 6 can additionally be connected to the plug housing 1 with fastening means, in particular with a screw-type connection. Alternatively, a latch-in connection can also be provided.

Figure 4C:
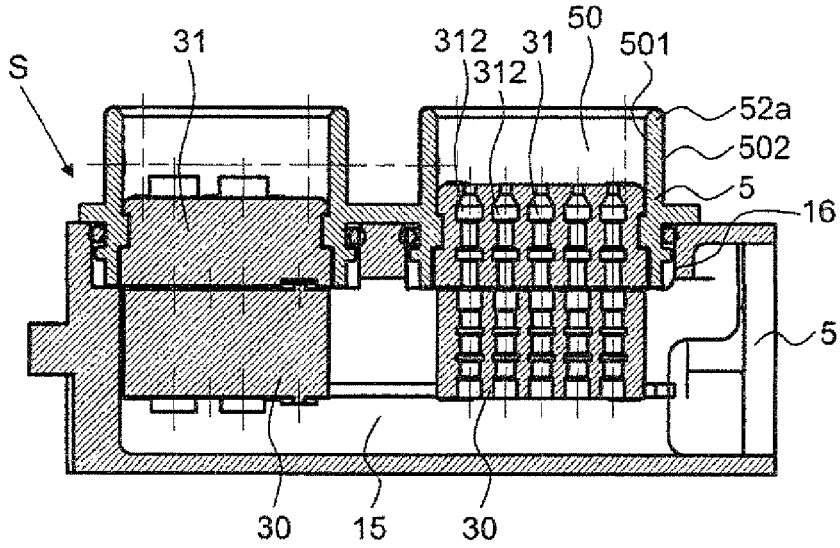
FIG. 4*c* shows a sectional illustration along the section line 4*c*-4*c* in FIG. 3, wherein the pin side is shown here.
Figure 4D:
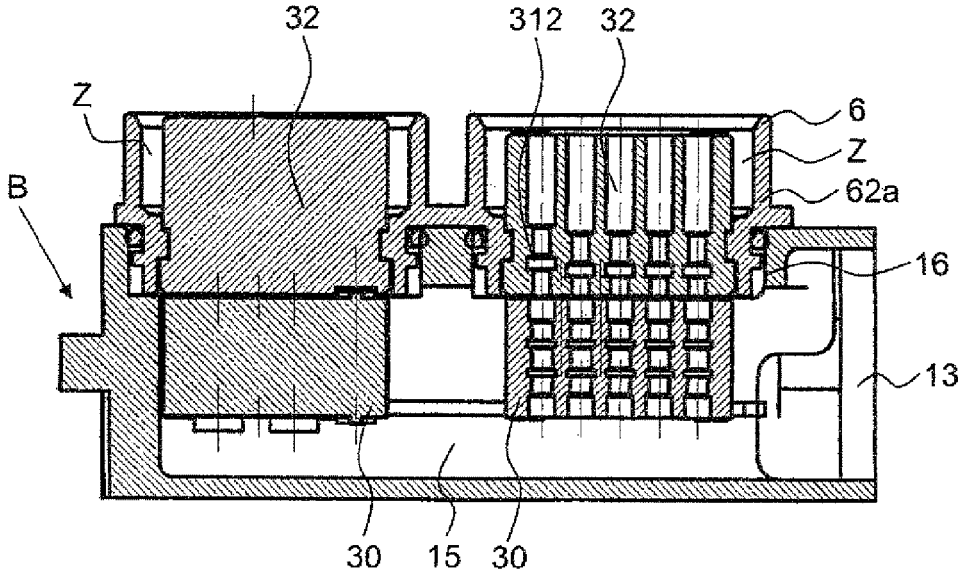
FIG. 4*d* shows a sectional illustration along the section line 4*d*-4*d* in FIG. 3, wherein the socket side is shown here.

FIGS. 4*c* and 4*d* show a section through the plug according to the invention along the section lines 4*c*-4*c* and 4*d*-4*d*, respectively. In this case, FIG. 4*c* shows the pin side and FIG. 4*d* shows the socket side B. The electrically conductive connecting elements are not shown in this illustration.

FIG. 4*d* illustrates an interspace Z between the wear element 32 and the side wall 62*a*. This interspace Z serves the purpose of accommodating the side wall 52*a* of the other frame element 5, as described previously.

These two sectional illustrations likewise show that the openings in the connection modules 30, the wear modules 31, 32 comprise different cutouts 312, 322 for accommodating the latching elements of the electrically conductive contact elements 7, 70, 71, 72. These cutouts 312, 322 have been described previously as elements which are complementary to the latching elements.

Figure 5:
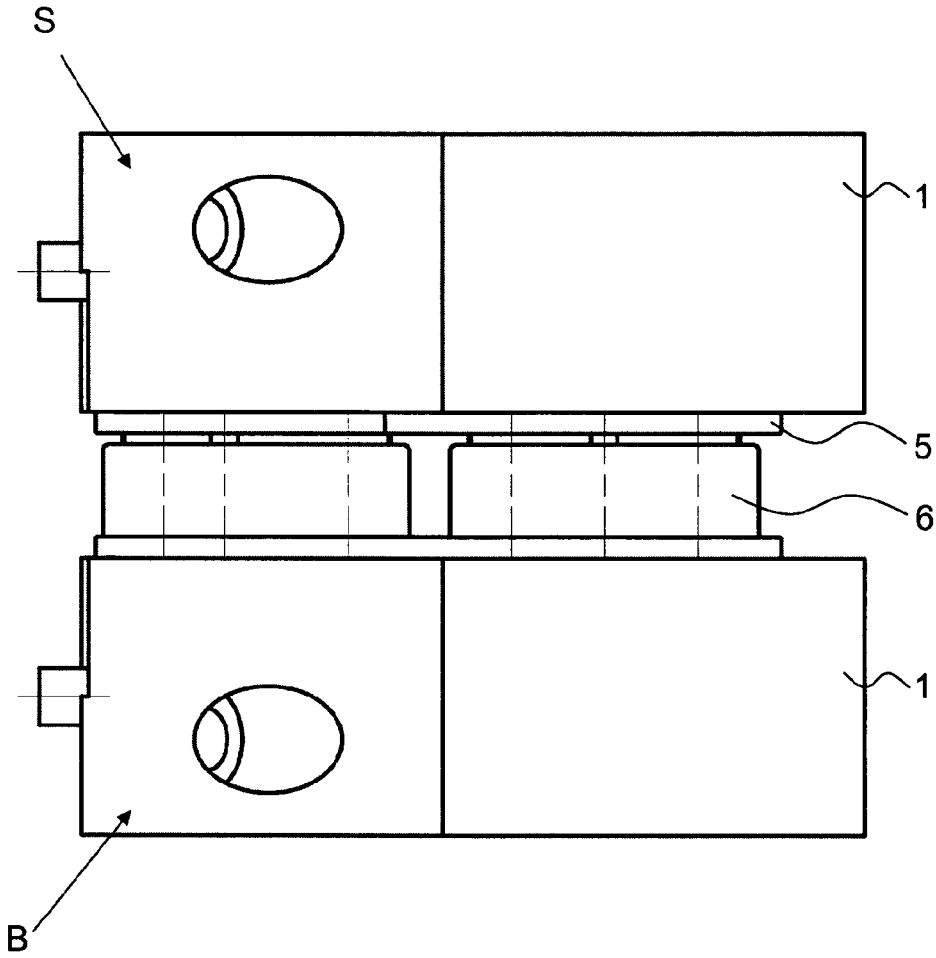
FIG. 5 shows a side view of the assembled plug in accordance with the present invention.

FIG. 5 shows a view of the assembled plug with the pin side S and the socket side B. In the present exemplary embodiment, both the plug on the pin side S and the plug on the socket side B comprise an identical number of plug modules 3. In alternative embodiments, as are illustrated in FIGS. 6-9, for example, a plug housing can also be designed to have only one plug module. The design of these plugs is substantially identical to the designs described above.

Figure 6:
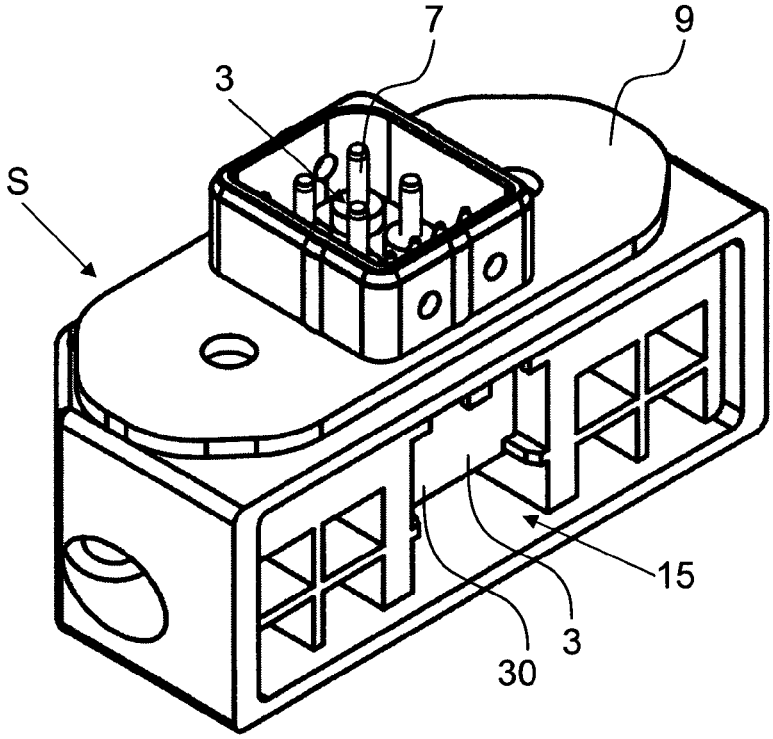
FIG. 6 shows a perspective view of a plug with a connecting module.

FIG. 6 shows a perspective view of the pin side S of a plug with only one plug module 3. The design of this plug is substantially similar to the exemplary embodiments already described above, and therefore only brief details are given of this embodiment at this juncture.

Figure 7:
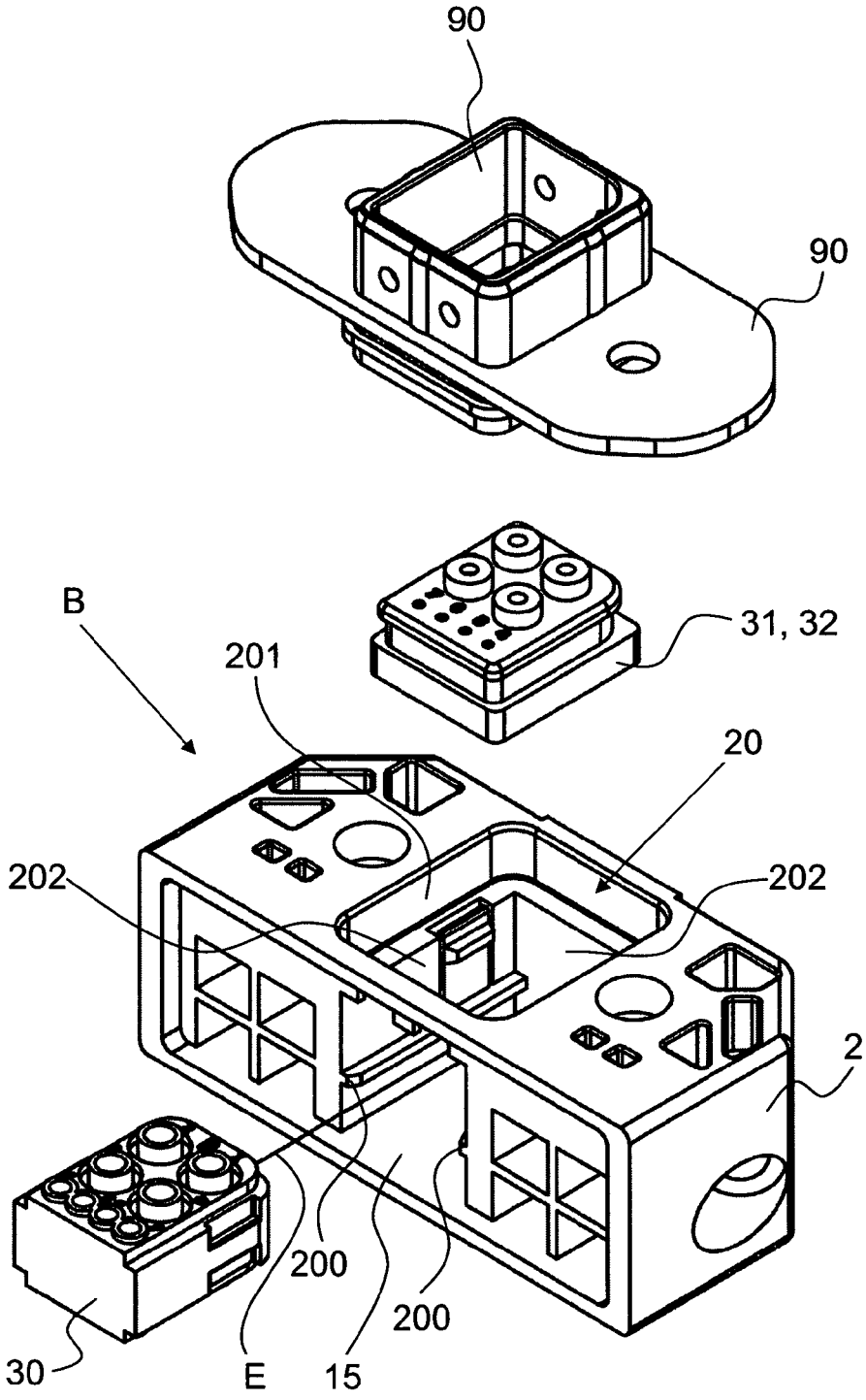
FIG. 7 shows a perspective, exploded illustration of FIG. 6.

FIG. 7 illustrates the socket side B of a plug with only one plug module 3 in an exploded illustration. The plug housing 2 comprises a contact chamber 20, which serves the purpose of accommodating the connection element 30. The contact chamber 20, as has already been described above, is equipped with guide elements 200 and latching elements 201. The contact chamber 20 is delimited by side walls 202. The connection element 30 can likewise be inserted into the contact chamber 20 along an insertion direction E. The frame element 9 is likewise designed to be identical to the frame elements 5, 6 which have already been described above. In this case, it comprises an accommodating chamber 90, which serves the purpose of accommodating a wear module 31, 32. The cable guide and the other features are configured analogously to the above-described exemplary embodiments. In addition, a coating described below can also be provided.

Figure 8:
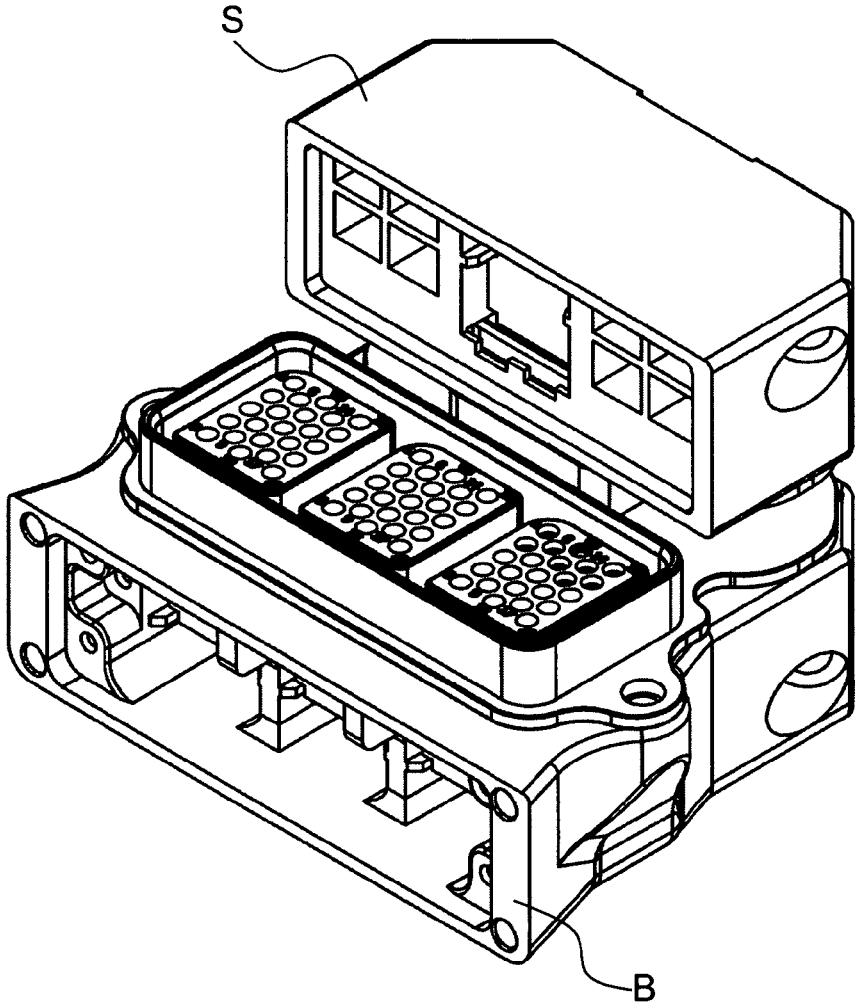
FIG. 8 shows a perspective view of the combination of a plug with a connecting module and a plug with four connecting modules.

FIG. 8 comprises the combination of a plug housing with a plug module (pin side S) and a plug housing with four plug modules (socket side B), of which three are arranged in a row and one is arranged outside of this row. This shows the varied and modular application of the present invention since it is possible for the plugs to be combined with one another in a variety of ways. Alternatively, a plug which comprises a plurality of, in particular three, contact chambers arranged in a row can also be provided. Other arrangements of the contact chambers are likewise conceivable. For example, it is conceivable to have a configuration which comprises three contact chambers arranged next to one another in a first row and two contact chambers arranged in a second row, wherein the second row is arranged behind the first row.

Preferably, the surface of the contact chambers 10, 10', 20 is coated with a metallic coating. In addition, the accommodating chambers 50, 60 can also be coated with a metallic coating on the inner side 501 and/or on the outer side 502. The metallic coating acts as a shield and can therefore prevent crosstalk between the individual plug modules 3. As a result, a first plug module can transmit control signals for a motor or another actuator, for example, and a module which is directly adjacent to said first plug module can transmit electrical power for the actuator. A coating consisting of aluminum oxide, copper, copper/chromium is preferably used as the metallic coating.

By coating the surface of the side wall 52*a*, which faces the side wall 62*a*, and by coating the surface of the side wall 62*a*, which faces the surface of the side wall 52*a*, the shielding effect can be further improved. In addition, it is conceivable for these two surfaces to come into electrical contact with one another.

As is shown by way of example in the sectional illustrations in FIGS. 4*a* and *b*, the frame element with the protruding-in side walls 52*a* and 62*a* provides extensive and continuous shielding by virtue of the coating of the relevant surface. As a result, a plug module 3 can be shielded successfully and efficiently from a further plug module 3. Preferably, the coating is in this case arranged in such a way that the coating of the contact chamber 10 can be electrically connected to the coating of the accommodating chamber 50, 60. In addition, parts of the opening 16 or the entire surface of the opening 16 can also be provided with a coating. Preferably, the coatings of adjacent contact chambers are DC-connected to one another. In alternative exemplary embodiments, it is also conceivable for the individual coatings of the contact chambers to be DC-isolated from one another.

If the cable which is connected to the corresponding connection module 30 has a dedicated shield, this shield should be guided so far into the contact chamber that the shield cannot become detached. Alternatively, the shield can be connected to a connection element 72, for example, and can be guided via the corresponding plug module, via the pin elements 70 and the socket elements 71, from the socket side B to the plug side S. In this case, the shield of the cable on the socket side B has the same voltage potential as the shield of the cable on the pin side S. Alternatively, the shield of the cable can also be connected to the electrochemical coating of the contact chamber 10. For example, it is conceivable to connect the shield of the cable to the surface coating by means of a screw or a soldered joint via contact chamber 10.

Preferably, the parts of the plug module 3, i.e. the connection module 30 and the wear modules 31, 32, are dimensioned in such a way that they have lateral play in the contact chamber 10 or in the accommodating chamber 50, 60. Preferably, each of the modules can be moved in each lateral axis through 0.25 mm to 0.5 mm. The lateral axes can best be seen in FIG. 3. In this case, the X axis and the Y axis, which is perpendicular thereto, are understood as the lateral axes. In other words, this means that each of the connection modules 30 and the wear modules 31, 32 can be moved from one end position into another end position through a maximum of 0.5 mm, i.e. for example from −X to +X. However, owing to the play, an angular rotation through the Y axis or through the X axis is also possible. By virtue of the provision of such large interspaces, angle errors can also be efficiently compensated for when the pin side is plugged together with the socket side. Likewise, corresponding play needs to be provided between the frame elements 5, 6 on the pin side S and on the socket side B. As a result of the play provided and as a result of the elasticity, angle errors and lateral positional errors can be compensated for. In addition, the pin element 70, the socket elements and the connection elements 72 can comprise angled bevels or chamfers in the relevant regions, which bevels or chamfers facilitate the assembly of the elements.

Alternatively, a contact chamber 10, which is not used for producing an electrical contact, can also be tightly sealed by a closure element.

LIST OF REFERENCE SYMBOLS

S Plug pin side
B Plug socket side
E Insertion direction
1 Plug housing (plurality of plug modules)
2 Plug housing (one plug module)
3 Plug module
5 Frame element pin side
6 Frame element socket side
7 Electrically conductive elements
8 Sealing element
9 Frame element (plug-in module)
10 Contact chamber
100 Guide elements
101 Latching elements
102 Side walls
103 Side walls
13 Opening
14 Opening
15 Channel
16 Opening/Step
30 Connection module
30' Connection module
31 Wear module for pins
32 Wear module for sockets
301 Cutouts
302 Guide cutouts
303 Openings for accommodating electrically conductive elements
310 Peripheral cutout
311 Surface of wear module for pins
312 Cutouts
313 Openings for accommodating electrically conductive elements
321 Surface of wear module for sockets
322 Cutouts
323 Openings for accommodating electrically conductive elements
50 Accommodating chamber
51 Carrier element
52*a* Side wall top
52*b* Side wall bottom
53 Latching elements
501 Outer side
502 Inner side
60 Accommodating chamber
61 Carrier element
62*a* Side wall top
62*b* Side wall bottom
63 Latching elements
70 Electrically conductive pin element
71 Electrically conductive socket element
72 Electrically conductive connection element
700 Latching elements
701 Contact section
702 Contact section
710 Cylindrical opening
721 Cylindrical opening
722 Connection point

The invention claimed is:

1. A plug for a tool changing system for electrically connecting a tool to a robot hand, comprising:

a plug housing configured to be fastened on a robot arm or on a tool, wherein said plug housing comprises at least one contact chamber and at least one accommodating chamber, which is arranged directly above the contact chamber;

connection modules each having electrically conductive elements configured to be connected to at least one first peripheral device, at least one of said connection module can be arranged in the at least one contact chamber, and wear modules having electrically conductive elements configured to be connected to a second peripheral device;

wherein at least one of the wear modules are arranged in the at least one accommodating chamber;

wherein the electrically conductive elements of the connection modules are configured to be connected to the electrically conductive elements of the wear modules;

wherein the at least one accommodating chamber is arranged in a frame element which is configured separately from the plug housing, wherein the frame element can be connected to the plug housing; and wherein the connection modules and the wear modules are made from an elastic and/or electrically insulating material.

2. The plug as claimed in claim 1, wherein the plug is a socket-side plug.

3. The plug as claimed in claim 2, wherein the electrically conductive elements in the wear modules of the plug are electrically conductive socket elements.

4. The plug as claimed in claim 1, wherein the plug is a pin-side plug.

5. The plug as claimed in claim 4, wherein the electrically conductive elements in the wear modules of the plug are electrically conductive pin elements.

6. The plug as claimed in claim 1, wherein the electrically conductive elements in the connection modules have a first side for connection to a peripheral device and a second side for connection to the electrically conductive elements of the wear modules.

7. The plug as claimed in claim 1, wherein the connection modules and the wear modules have through-openings, which serve the purpose of accommodating the electrically conductive elements.

8. The plug as claimed in claim 1, wherein the electrically conductive elements in the connection modules can be connected to the electrically conductive elements in the wear modules via a plug-type connection.

9. The plug as claimed in claim 1, wherein the connection modules have an identical design for the socket side and the pin side of the plug.

10. The plug as claimed in claim 1, wherein the connection modules and the wear modules each comprise openings defined according to a particular hole pattern, and the hole pattern of the openings in the connection modules is identical to the hole pattern of the openings in the corresponding wear modules.

11. The plug as claimed in one claim 1, wherein the number of electrically conductive connections per connection modules or wear modules is greater than 3.

12. The plug as claimed in claim 1, wherein the contact chamber comprises guide elements for guiding the connection modules.

13. The plug as claimed in claim 1, wherein the contact chamber comprises latching elements for latching the connection modules.

14. The plug as claimed in claim 1, wherein the accommodating chamber comprises latching elements for latching the wear modules.

15. The plug as claimed in claim 1, wherein an insertion direction of the connection modules into the plug housing is at an with respect to an insertion direction of the wear modules into the plug housing or the frame element.

16. The plug as claimed in claim 15, wherein the angle is a right angle.

17. The plug as claimed in claim 1, wherein lateral play is provided between the connection modules and the contact chamber.

18. The plug as claimed in claim 1, wherein lateral play is provided between the wear modules and the accommodating chamber.

19. The plug as claimed in claim 18, wherein the lateral play is preferably between 0.25 mm and 0.5 mm per side.

20. The plug as claimed in claim 1, wherein parts of the frame element protrude into the plug housing, and wherein the frame element is fastened on the plug housing by fastening means.

21. The plug as claimed in claim 1, wherein the plug housing and the frame element are configured in two pieces.

22. The plug as claimed in claim 1, wherein the plug housing and the frame element are configured in one piece.

23. The plug as claimed in claim 1, wherein the plug comprises a plurality of contact chambers arranged next to one another in at least one of the configurations of a row, a single or a plurality of contact chambers, which are arranged offset towards a rear with respect to this row.

24. The plug as claimed in claim 1, wherein the plug comprises a single contact chamber.

25. The plug as claimed in claim 1, wherein the first peripheral device is a cable, which can be guided out of the plug via an opening or a channel.

26. The plug as claimed in claim 1, wherein surfaces of the contact chambers are provided with an electrically conductive coating, wherein the coatings of the individual contact chambers are DC-isolated from one another and/or DC-connected to one another.

27. The plug as claimed in claim 26, wherein the coating of at least one contact chamber can be connected or can be caused to make contact with the coating of an accommodating chamber, which is above the contact chamber.

28. The plug as claimed in claim 1, wherein surfaces of the accommodating chambers are provided with an electrically conductive coating, wherein the coatings of the individual accommodating chambers are at least one of DC-isolated from one another or DC-connected to one another.

29. The plug as claimed in claim 28, wherein the coating of at least one contact chamber can be connected or can be caused to make contact with the coating of an accommodating chamber, which is above the contact chamber.

30. The plug as claimed in claim 28, wherein a shield of a cable can be connected to the coating.

31. The plug as claimed in claim 1, wherein a shield of a cable on the socket side can be connected to an electrically conductive element, and wherein the shield of a cable on the pin side can be connected to an electrically conductive element, such that the shield can be guided via the electrically conductive elements from a pin side to a socket side.

32. A method for assembling a plug as claimed in claim 1, wherein the connection modules are equipped with electrically conductive elements, which are connected to a first peripheral device, and the wear modules are equipped with electrically conductive elements, and the connection modules are arranged in the contact chambers and the wear modules are arranged in the accommodating chambers.

33. The method as claimed in claim 32, wherein the wear modules are arranged in the accommodating chambers in the frame element, and the frame elements are connected to the corresponding plug housing.

34. The plug as claimed in one claim 1, wherein the number of electrically conductive connections per connection modules or wear modules is greater than 5.

35. A plug-type connection configured for producing an electrical contact between a robot hand and a tool, comprising a socket-side plug and a pin-side plug, wherein at least one of the socket-side plug and the pin-side plug comprises the plug according to claim 29.

* * * * *